US008979185B1

(12) United States Patent
Redel

(10) Patent No.: US 8,979,185 B1
(45) Date of Patent: Mar. 17, 2015

(54) TWO-POSITION FOLDING CHAIR

(71) Applicant: Ray H. Redel, Saint Louis, MO (US)

(72) Inventor: Ray H. Redel, Saint Louis, MO (US)

( * ) Notice: Subject to any disclaimer, the term of this patent is extended or adjusted under 35 U.S.C. 154(b) by 0 days.

(21) Appl. No.: 14/461,740

(22) Filed: Aug. 18, 2014

(51) Int. Cl.
*A47C 4/26* (2006.01)
*A47C 4/16* (2006.01)
*A47C 4/50* (2006.01)

(52) U.S. Cl.
CPC ... *A47C 4/26* (2013.01); *A47C 4/16* (2013.01); *A47C 4/50* (2013.01)
USPC ..... 297/19; 297/57

(58) Field of Classification Search
USPC ..... 297/19, 21, 56, 57
See application file for complete search history.

(56) References Cited

U.S. PATENT DOCUMENTS

| | | | | |
|---|---|---|---|---|
| D931,864 | | 8/1909 | Hall | |
| 1,366,274 | A | 1/1921 | Orth | |
| 1,516,778 | A | 11/1924 | Naysmith | |
| 2,381,149 | A | 10/1933 | Baker | |
| 2,107,629 | A | 2/1938 | Hopkins | |
| 2,598,872 | A | 6/1952 | Wiesztort | |
| 2,649,140 | A * | 8/1953 | Housel | 297/46 |
| 2,722,970 | A | 11/1955 | Stechmann | |
| 2,732,006 | A * | 1/1956 | Crescent | 297/320 |
| 1,354,133 | A | 2/1961 | DeGen | |
| 2,976,912 | A | 3/1961 | Dias | |
| 3,033,511 | A | 5/1962 | McAfee | |
| 4,025,107 | A | 5/1977 | Chippa | |
| 4,125,286 | A | 11/1978 | Redel | |
| 4,162,806 | A | 7/1979 | Cho | |
| 4,341,417 | A | 7/1982 | Deconinck | |
| 4,456,294 | A * | 6/1984 | Lange et al. | 297/21 |
| 4,890,881 | A | 1/1990 | Kleinklaus | |
| 4,906,042 | A * | 3/1990 | Ollat | 297/19 |
| 5,060,896 | A | 10/1991 | Hobbins | |
| 5,110,180 | A | 5/1992 | Schneider | |
| 5,211,443 | A * | 5/1993 | Kelly | 297/56 |
| 5,244,249 | A | 9/1993 | Tseng | |
| 5,464,268 | A | 11/1995 | Levrangi | |
| 5,494,333 | A | 2/1996 | Wilson | |

(Continued)

FOREIGN PATENT DOCUMENTS

| | | |
|---|---|---|
| BE | 568555 | 6/1958 |
| CH | 269125 | 6/1950 |

(Continued)

*Primary Examiner* — Peter Brown
(74) *Attorney, Agent, or Firm* — Don V. Kelly; Evans & Dixon, LLC

(57) ABSTRACT

A folding chair has a seat component, a back component and a leg component. The seat component has a seat rear and a guide-support bar. The leg component comprises two pairs of legs, the first pair comprising a first and second leg and the second pair comprising a third and fourth leg. A cross member extends from the third leg to the fourth leg. The back component comprises a vertical element. The bottom of the vertical element is connected to the cross member and extends upwardly therefrom. The seat front is pivotally attached to the first and second legs and the seat rear is not connected to either the leg component or the back component, allowing the seat rear to slidably travel along vertical element. When the seat rear is at the vertical element top, the chair is in a folded configuration. When the seat rear is situated at the vertical element bottom, the chair is in a first sitting configuration. The vertical element includes at least one catch adapted to receive the guide-support bar and hold the seat rear such that the chair is in a second sitting configuration.

9 Claims, 27 Drawing Sheets

(56) References Cited

U.S. PATENT DOCUMENTS

| | | | | |
|---|---|---|---|---|
| 6,036,148 | A | 3/2000 | Shank | |
| 6,056,353 | A | 5/2000 | Meara | |
| 6,106,056 | A | 8/2000 | Wegner | |
| 6,361,107 | B1 | 3/2002 | Alexander | |
| D512,576 | S | 12/2005 | Szyperski | |
| 7,147,277 | B1 * | 12/2006 | Miller | 297/19 |
| 8,231,171 | B2 * | 7/2012 | Leng | 297/56 |
| 2010/0219665 | A1 | 9/2010 | Carrier | |
| 2013/0033073 | A1 | 2/2013 | Gendell | |

FOREIGN PATENT DOCUMENTS

| | | | |
|---|---|---|---|
| CH | 282678 | | 5/1952 |
| CH | 353501 | | 4/1961 |
| CN | 2075474 | | 4/1991 |
| CN | 200947948 | | 9/2007 |
| DE | 802009 | | 2/1951 |
| DE | 818089 | | 10/1951 |
| DE | 1254311 | | 11/1967 |
| DE | 7904258 | | 5/1979 |
| DE | 3029577 | | 3/1982 |
| DE | 3029558 | | 4/1982 |
| DE | 3322788 | | 1/1984 |
| DE | 3414584 | | 10/1985 |
| DE | 8711439 | | 10/1987 |
| DE | 3728144 | | 3/1989 |
| DE | 3933915 | | 4/1991 |
| DE | 9418675 | | 3/1996 |
| DE | 4441518 | | 5/1996 |
| DE | 202013100020 | | 1/2013 |
| EP | 1847199 | A | 10/2007 |
| FR | 1198214 | | 12/1959 |
| FR | 2317894 | | 2/1977 |
| FR | 2338019 | | 8/1977 |
| FR | 2453617 | | 11/1980 |
| FR | 2797166 | | 2/2001 |
| GB | 196568 | | 8/1923 |
| GB | 226036 | | 12/1924 |
| GB | 668596 | | 3/1952 |
| GB | 866540 | | 4/1961 |
| JP | 59034360 | | 9/1984 |
| JP | 03096754 | | 10/2003 |
| KR | 20090132054 | | 12/2009 |
| KR | 20100004155 | | 4/2010 |
| WO | 2008001093 | | 1/2008 |

* cited by examiner

TWO-POSITION FOLDING CHAIR

CROSS REFERENCE TO RELATED APPLICATION

Not applicable.

STATEMENT REGARDING FEDERALLY SPONSORED RESEARCH OR DEVELOPMENT

Not applicable.

SEQUENCE LISTING, TABLE OR COMPUTER PROGRAM ON COMPACT DISC

Not applicable.

FIELD OF INVENTION

This invention relates to adjustable folding chairs.

BACKGROUND OF THE INVENTION

Folding chairs have long been used to provide a storable means of providing seating for visiting guests at family and home gatherings. They are also used in commercial, civic and social settings to accommodate attendees at weddings, conventions, seminars and conferences. The folding chair of the prior art used for the foregoing purposes suffers from the deficit that that chair is designed to accommodate an occupant in one specific sitting position. Usually the sitting position offered by the prior art folding chair represents a hybrid position somewhere between that offered by a dining table chair (18-inch seat height) and that offered by a more reclined and lower, easy-chair position. In this respect, the prior art folding chair can only be comfortably and practically used in conjunction with a card table (26-inch table height).

U.S. Pat. No. 6,305,742 discloses a typical folding chair known in the prior art. With this type of chair, the rear of the seat component is pivotally attached to a rigid frame. The rigid frame constitutes the back component of the chair and the two forward extending legs of the chair. When the chair is configured for the sitting position, the legs of the frame respectively emanate from the rear of the seat component from their pivot points and extend downwardly and forward to the floor below the front of the seat component. The back component of the frame typically has an attached back rest. As noted, these type chairs are generally adapted for use with portable, folding card tables of lower height than a typical dining table, which has a table height of thirty inches. Hence, the folding chair of the prior art is not the proper height for a dining chair. As such, the prior art folding chair does not allow for use in a dining setting as it does not allow: a) the occupant to sit at a seat height level appropriate for a dining table; and b) the occupant to sit at a height level commensurate with other diners at the table. Nor does the prior art folding chair provide the comfort of a chair that one would find in a family den or living room with a height appropriate for an end table (cocktail) table.

SUMMARY OF THE INVENTION

The instant invention addresses the deficits of the prior art folding chair by providing for a folding chair capable of assuming a folded position, a first sitting position and a second sitting position. The first sitting position is the appropriate height and angle for seating adjacent a cocktail table. The second two sitting position is the appropriate height and angle to complement a dining table.

The present invention overcomes the noted deficits with the prior art by providing for a folding chair that can be adjusted in seconds from a folded position to either of a first sitting position or a second sitting position. The first sitting position is a position appropriate for use near or adjacent to a cocktail table. In this respect, the chair can be unfolded and configured to an "easy-chair" position, with the seat height at sixteen inches. The second sitting position can offer a seat height of eighteen inches and a correct angle for a dining chair and thus, offers a position appropriate for use at a dining table. Furthermore, the inventive chair can be folded to a flat state.

To achieve the features described above the present invention folding chair comprises a seat component, a back component and a leg component. The seat component has a seat front and a seat rear. The back component is connected to the seat rear. The leg component comprises a first pair of legs. This first pair of legs includes a first leg and a second leg. The leg component also has a second pair of legs. This second pair of legs comprises a third leg and a fourth leg. Each of the legs has a top and a bottom.

When the chair is configured in a sitting position, the first and second legs each descend downward and rearward from the front seat region. The legs are generally parallel to each other and are situated on opposite sides of the chair. When the chair is configured in a sitting position, the third and fourth legs each descend downward and forward from the rear seat region. The third and fourth legs are generally parallel to each other and are similarly situated on opposite sides of the chair. The first leg is pivotally connected to the third leg such that the bottom of the legs move in scissor fashion in relation to each other as the chair is moved and configured between folded and sitting positions. The second leg is similarly pivotally connected to the fourth leg.

A first cross member extends from the top of the third leg to the top of the fourth leg and provides rigidity to the chair and also provides a structure upon which the back component can be mounted. The back component comprises a vertical element. The vertical element has a top and bottom. The bottom of the vertical element is connected to the first cross member and extends vertically upward from it. The ability of the chair to fold and adjust is achieved from the following arrangement of the seat component with the leg component and back component. In contrast to the folding chair of the prior art, the seat front is pivotally attached to the tops of the first and second legs. Further, the seat rear is not connected (mechanically attached) to either the leg component or the back component. The guide-support bar attached to the seat rear runs generally parallel to the seat rear but is located at a distance from the rear seat edge of the seat rear. This distance creates a space between the guide-support bar and the rear seat edge in which the vertical element of the back component extends through. By virtue of this arrangement, the seat rear is adapted for slidable travel along the vertical element. As used herein in reference to the action of the seat rear in relation to the vertical element, the term "along" does not limitedly mean slidable travel in constant contact with the vertical element, but also longitudinal travel adjacent to that surface. As such, the seat rear can slidably move between the top and bottom of the vertical element of the back component. When the seat rear is situated at its position of topmost travel along the vertical element the chair is in the folded position. When the seat rear is situated at its position of bottommost travel along the vertical element the chair is in a first sitting position.

To allow the chair to assume a second sitting position, the vertical element of the back component includes at least one catch adapted to receive the guide-support bar attached to the seat rear. Preferably, the catch is situated on the rear surface of the lower part of the vertical element. To allow the chair to assume a dining chair position the catch is optimally located on the vertical element at a situs several centimeters above the bottom of the vertical element. The catch is preferably an upward facing hook or slot that holds the guide-support bar when the guide-support bar is dropped into it. When the catch holds the guide-support bar in this fashion the chair is configured in the second sitting position.

DETAILED DESCRIPTION

Figure 1:
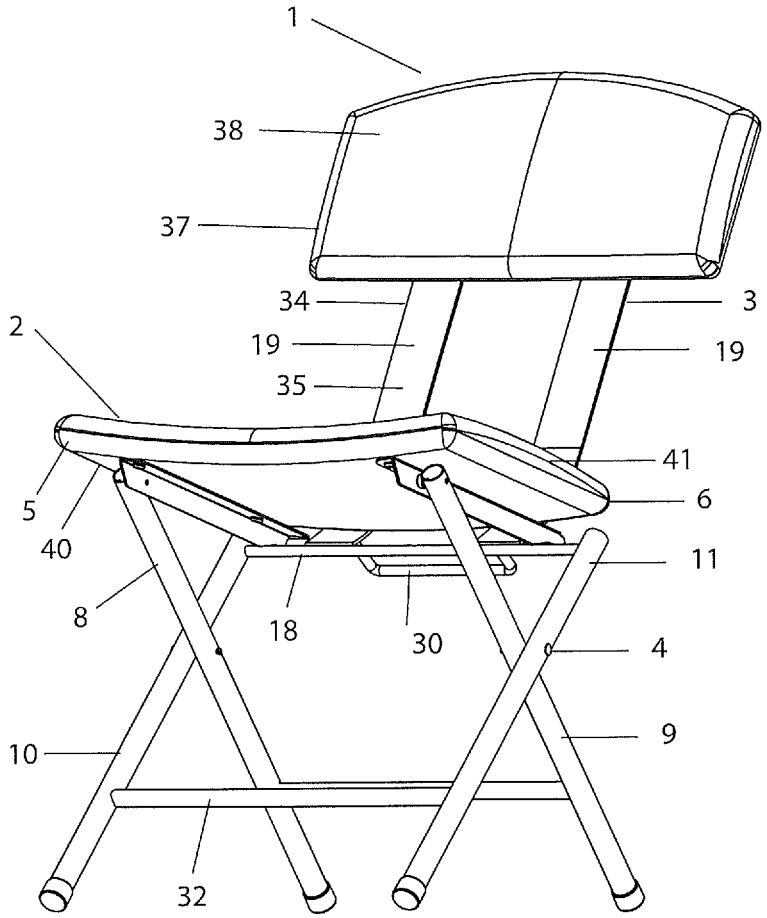
FIG. 1 is a front perspective view of an embodiment of the present invention chair configured to accommodate a first (relaxed) sitting position.
Figure 2:
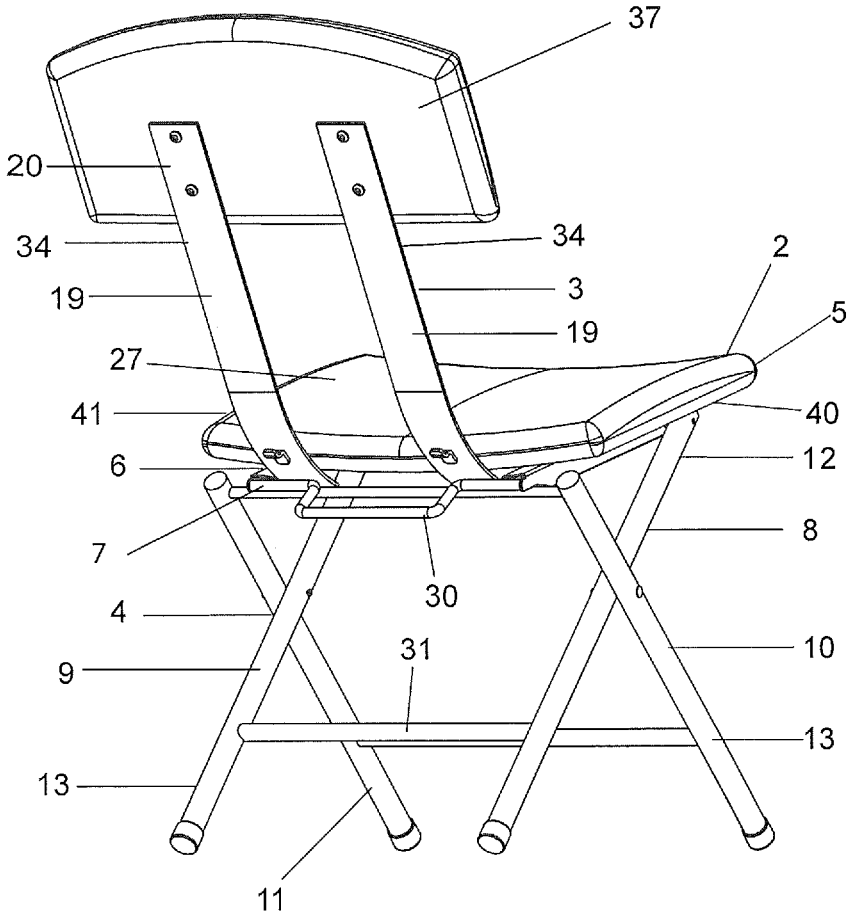
FIG. 2 is a rear perspective view of the embodiment chair configured for the first sitting position.
Figure 3:
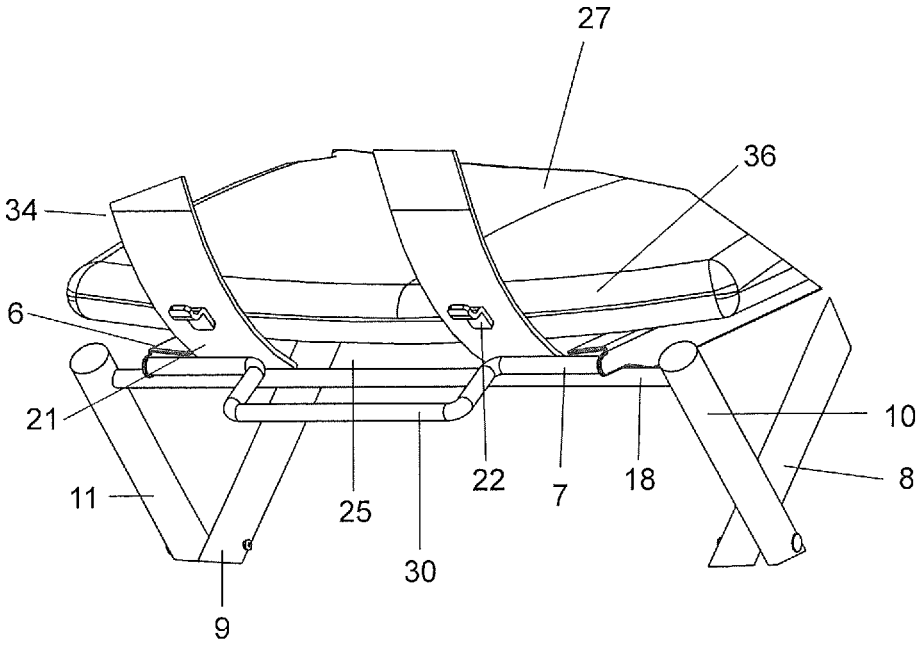
FIG. 3 is an enlarged view of a portion of the rear of the chair shown in FIG. 2 showing the location where the vertical element connects to the first cross member of the leg component and the seat rear is situated at the bottom of the vertical element when the embodiment chair is configured for the first sitting position.
Figure 4:
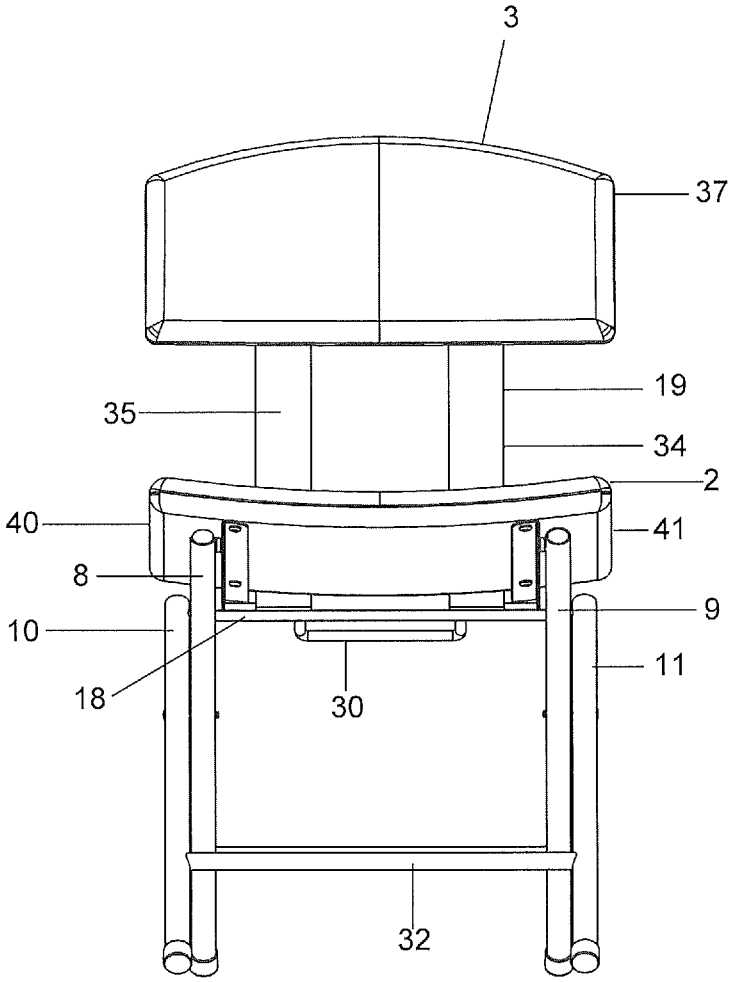
FIG. 4 is a front elevation view of the embodiment chair configured for the first sitting position.
Figure 5:
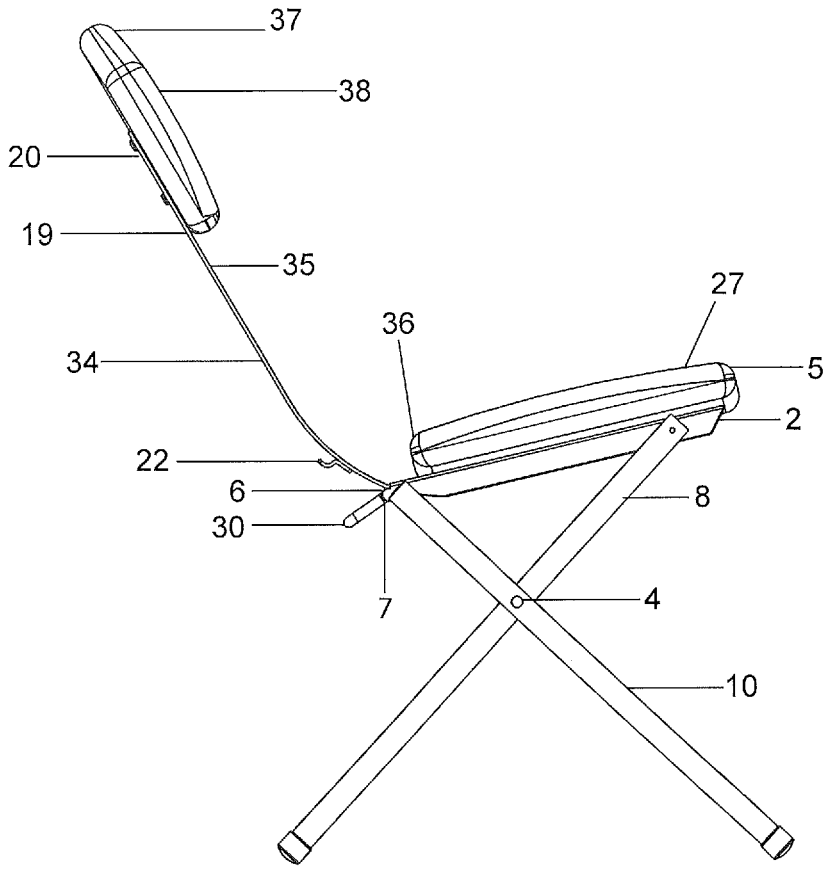
FIG. 5 is a right side elevation view of the embodiment chair configured for the first sitting position.
Figure 6:
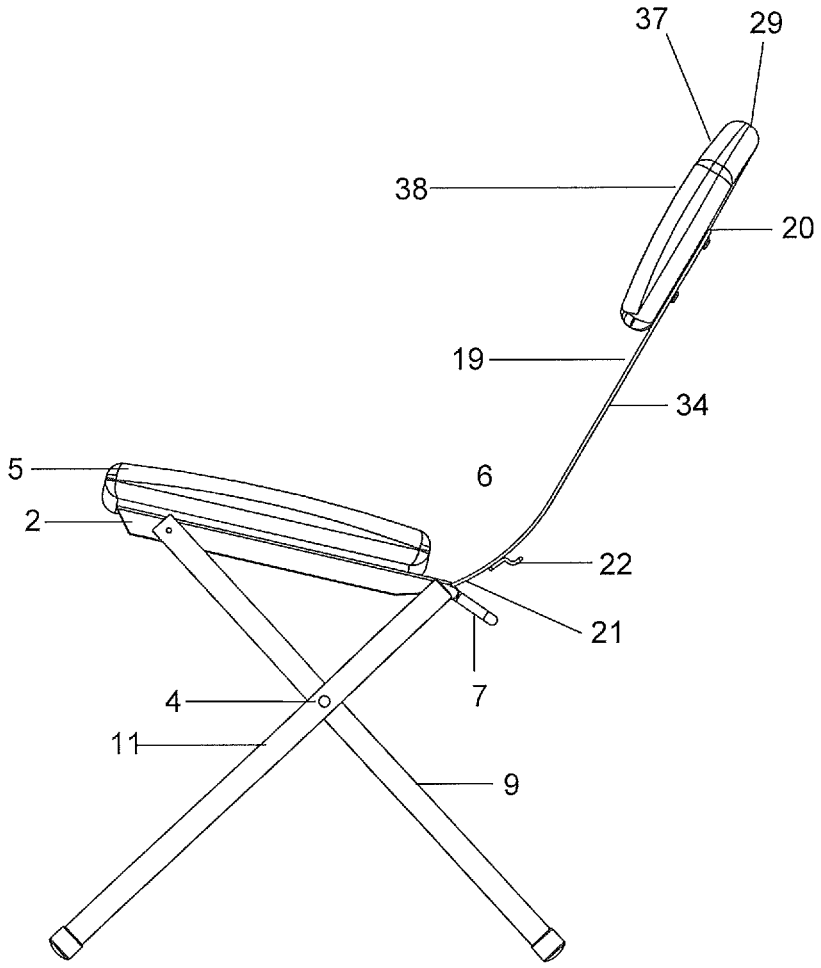
FIG. 6 is a left side elevation view of the embodiment chair configured for the first sitting position.
Figure 7:
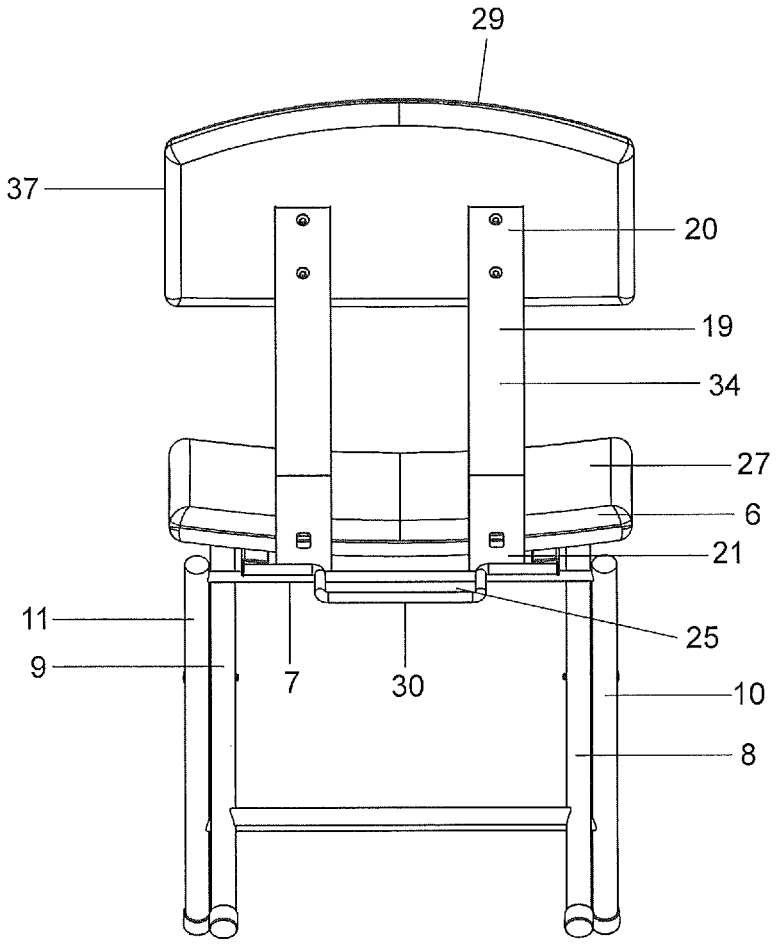
FIG. 7 is a rear elevation view of the embodiment chair configured for the first sitting position.
Figure 8:
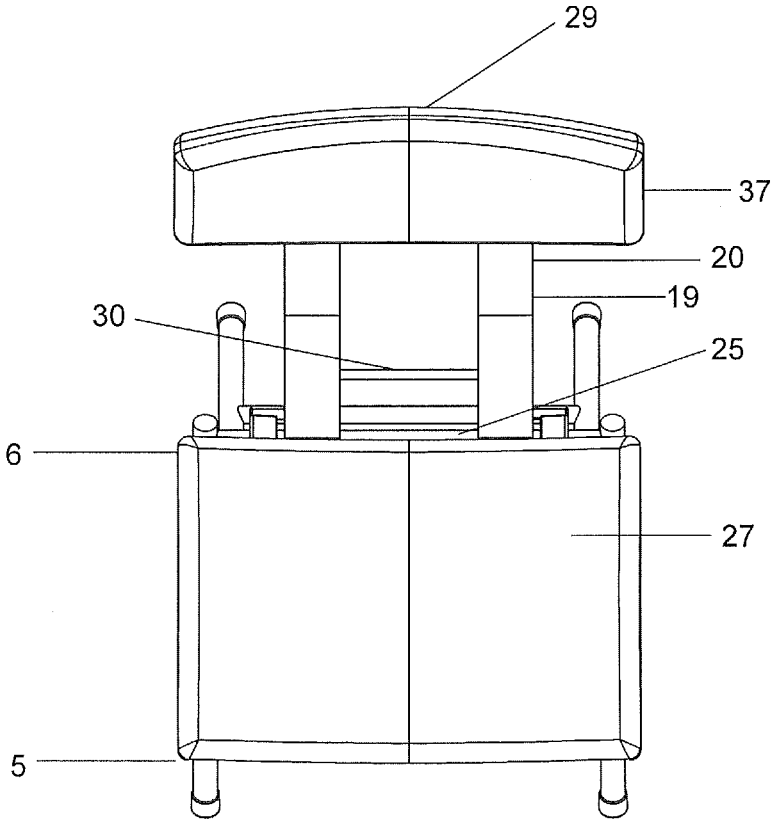
FIG. 8 is a top plan view of the embodiment chair configured for the first sitting position.
Figure 9:
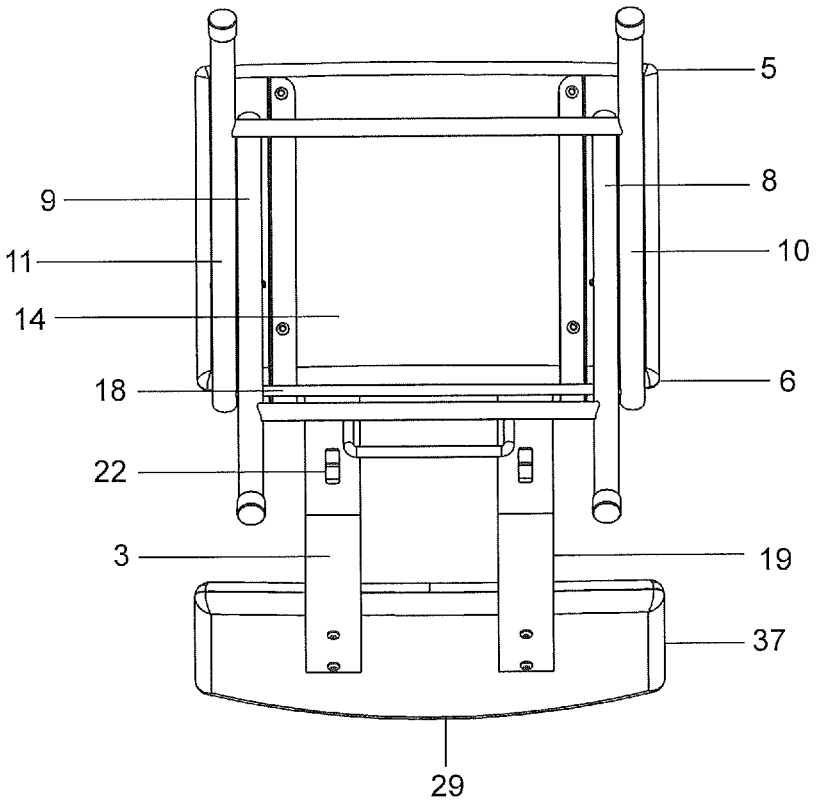
FIG. 9 is a bottom plan view of the embodiment chair configured for the first sitting position.
Figure 10:
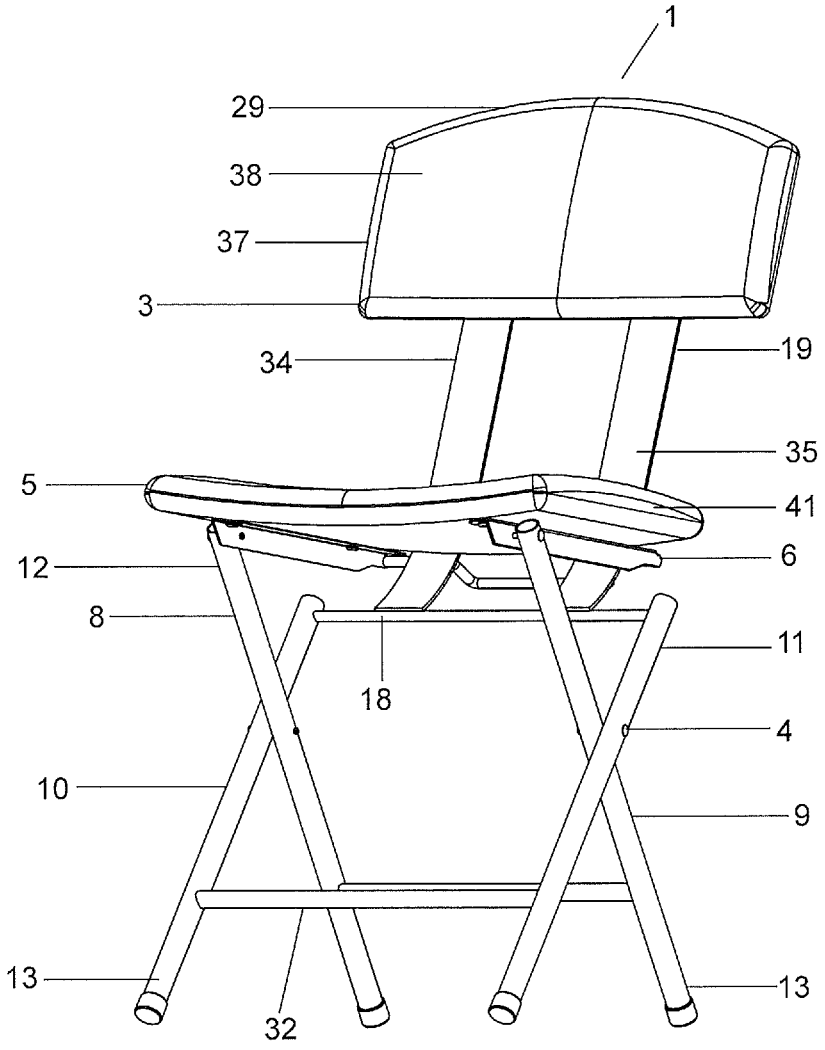
FIG. 10 is a front perspective view of the same embodiment of the present invention chair configured to accommodate a second (dining) sitting position.
Figure 11:
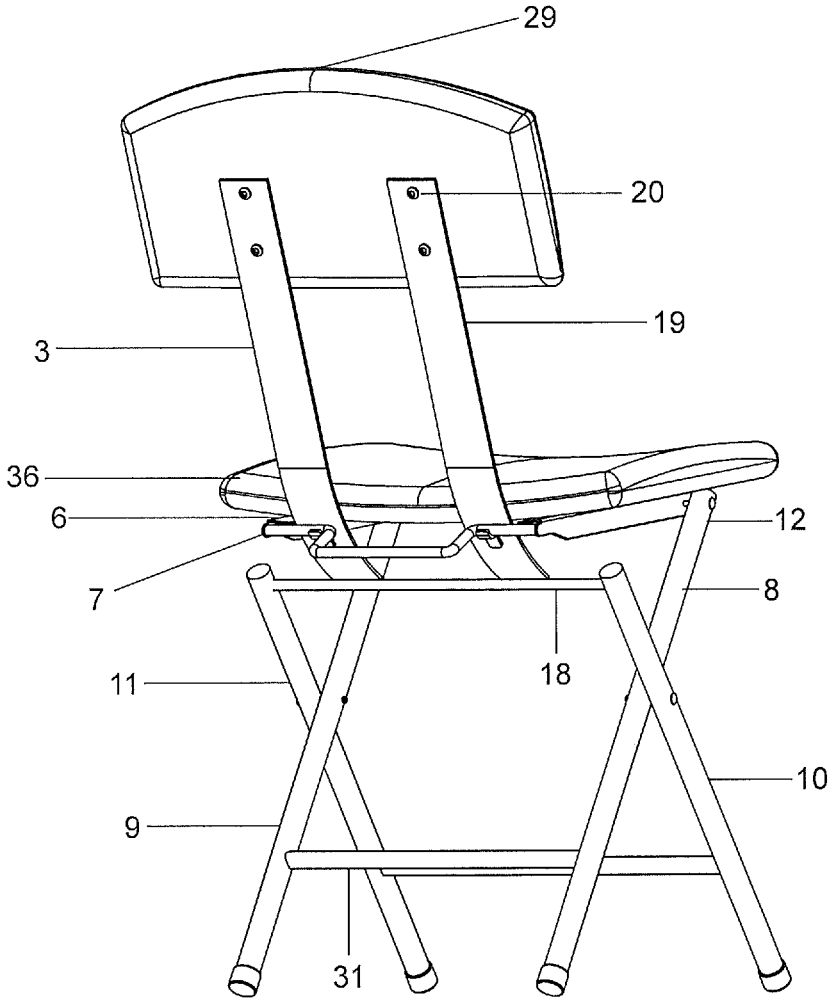
FIG. 11 is a rear perspective view of the embodiment chair configured for the second sitting position.
Figure 12:
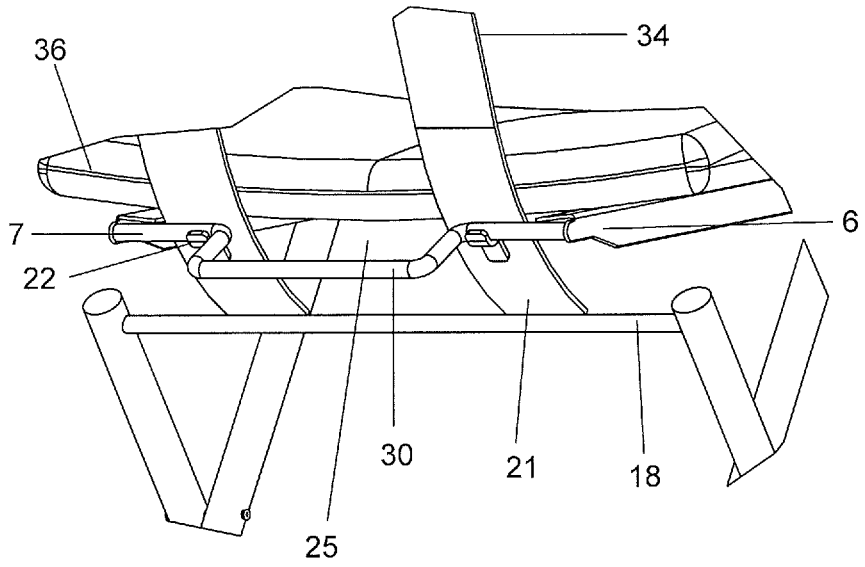
FIG. 12 is an enlarged view of a portion of the rear of the chair shown in FIG. 11 showing the location where the vertical element connects to the first cross member of the leg component and the guide-support bar being held in the catches on the vertical element when the embodiment chair is configured for the second sitting position.
Figure 13:
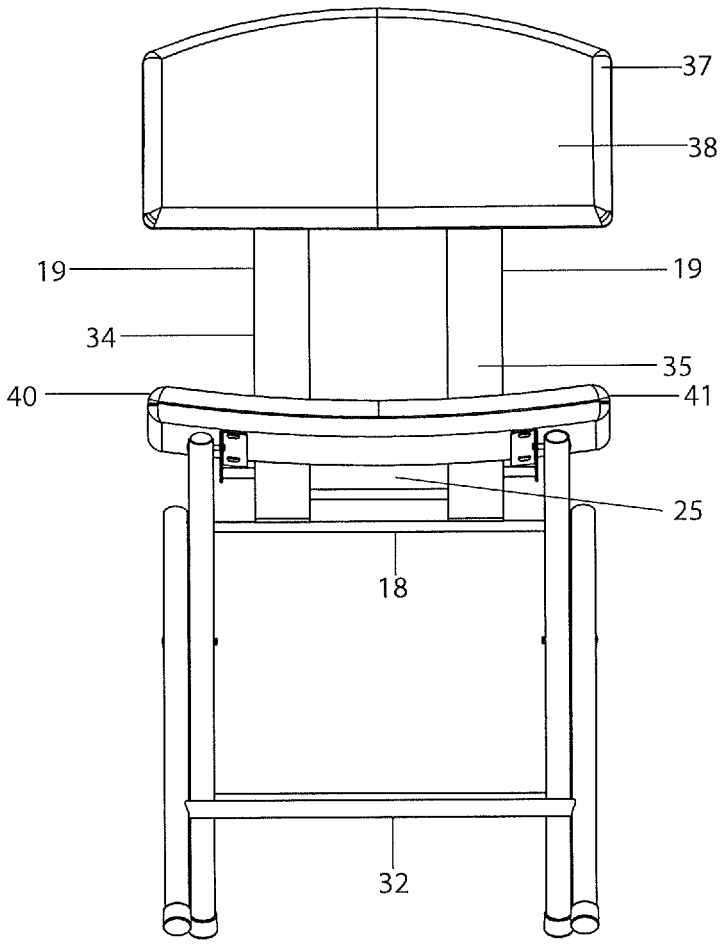
FIG. 13 is a front elevation view of the embodiment chair configured for the second sitting position.
Figure 14:
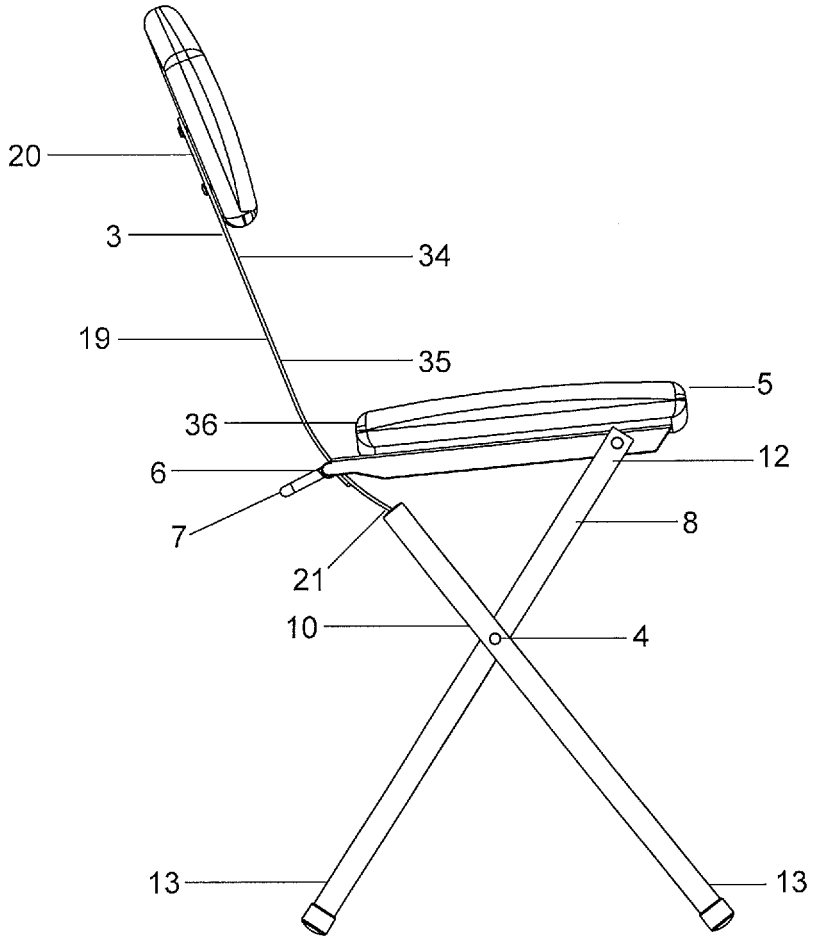
FIG. 14 is a right side elevation view of the embodiment chair configured for the second sitting position.
Figure 15:
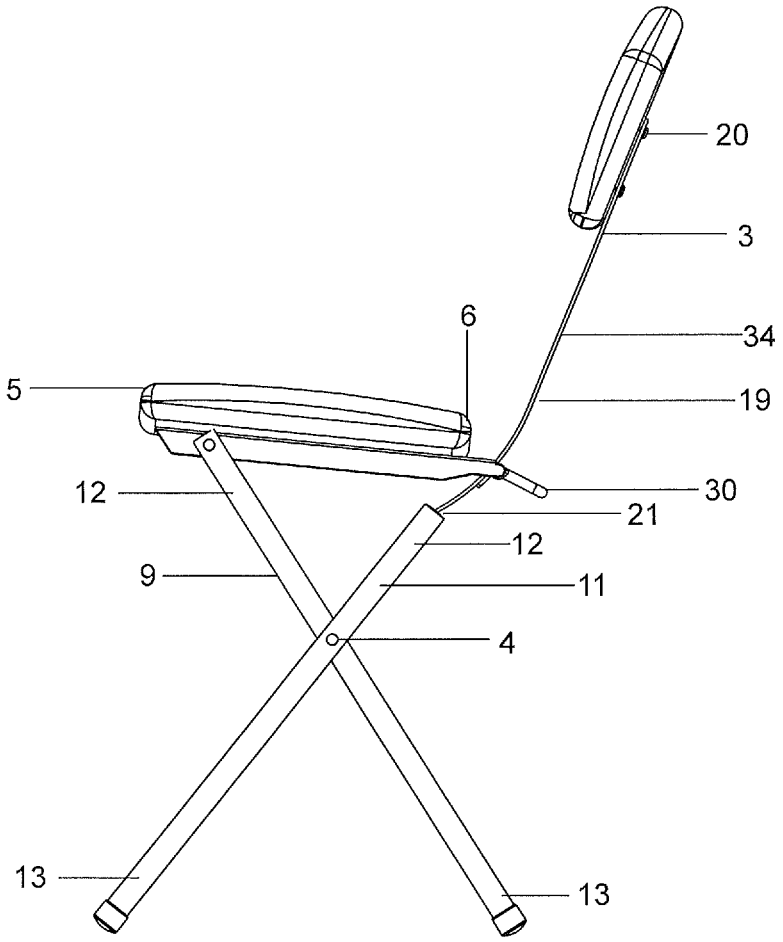
FIG. 15 is a left side elevation view of the embodiment chair configured for the second sitting position.
Figure 16:
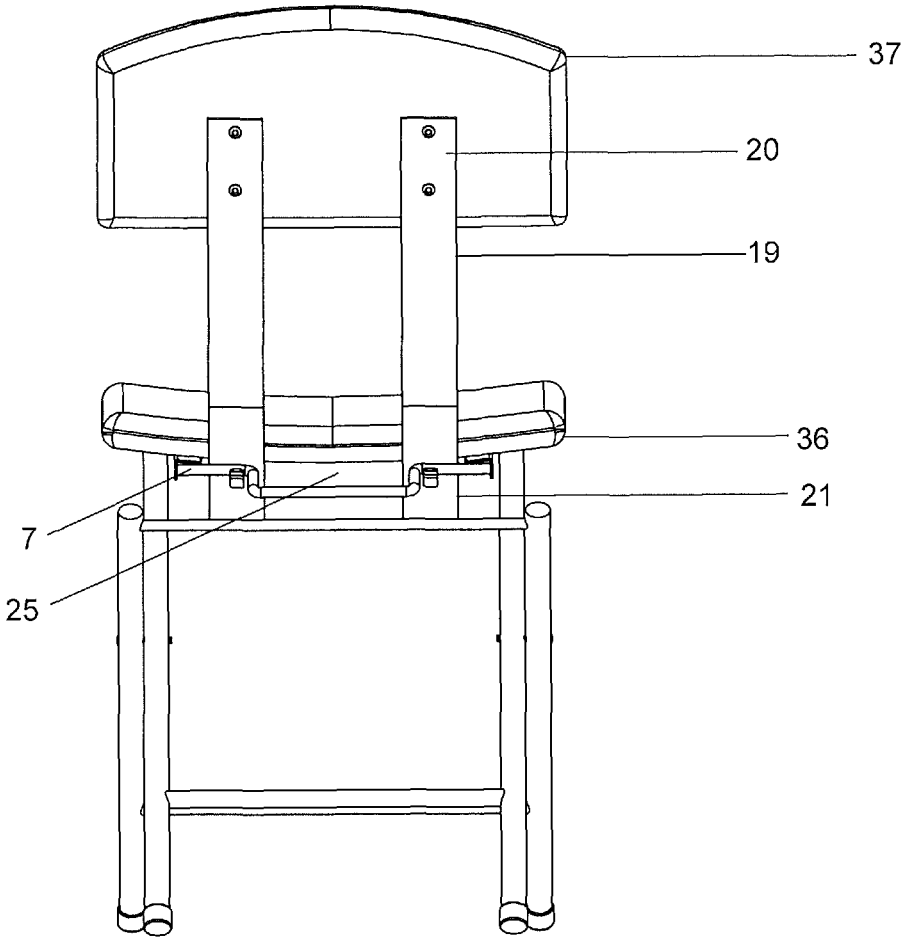
FIG. 16 is a rear elevation view of the embodiment chair configured for the second sitting position.
Figure 17:
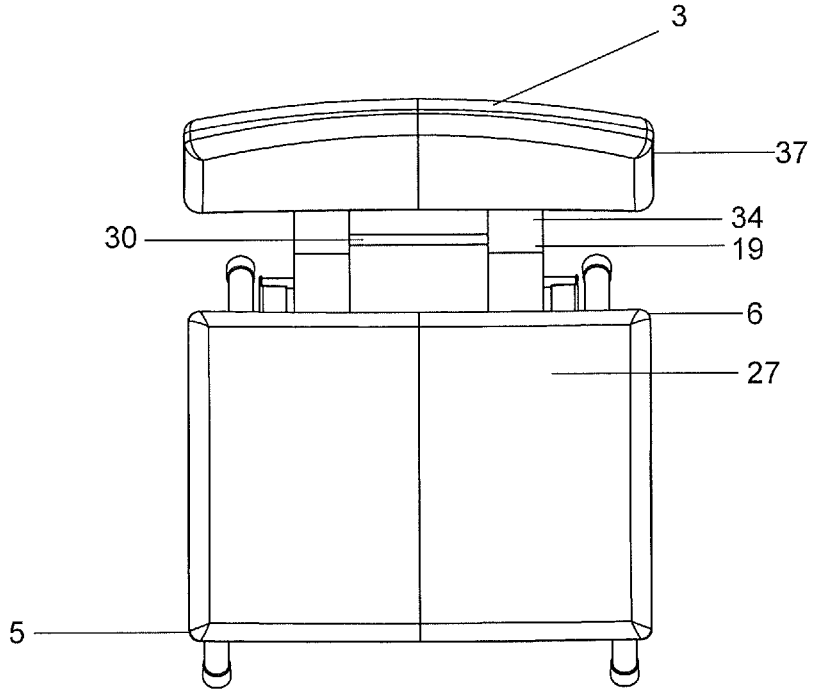
FIG. 17 is a top plan view of the embodiment chair configured for the second sitting position.
Figure 18:
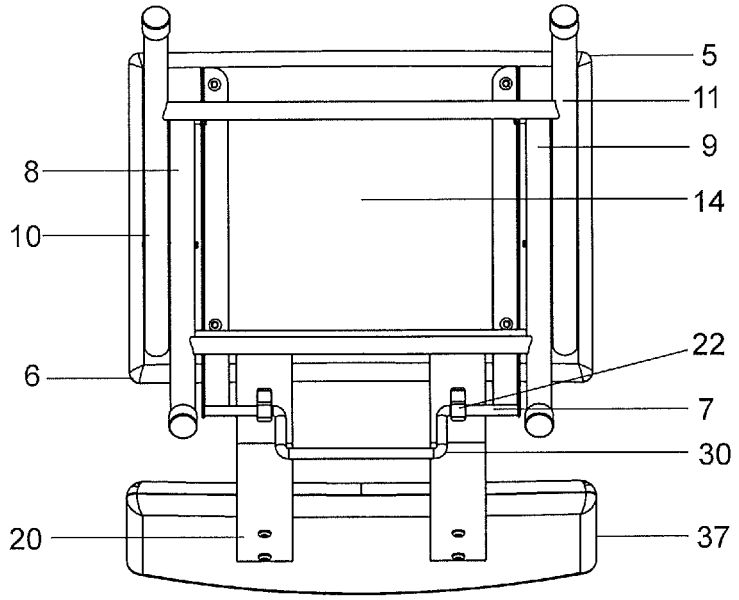
FIG. 18 is a bottom plan view of the embodiment chair configured for the second sitting position.
Figure 19:
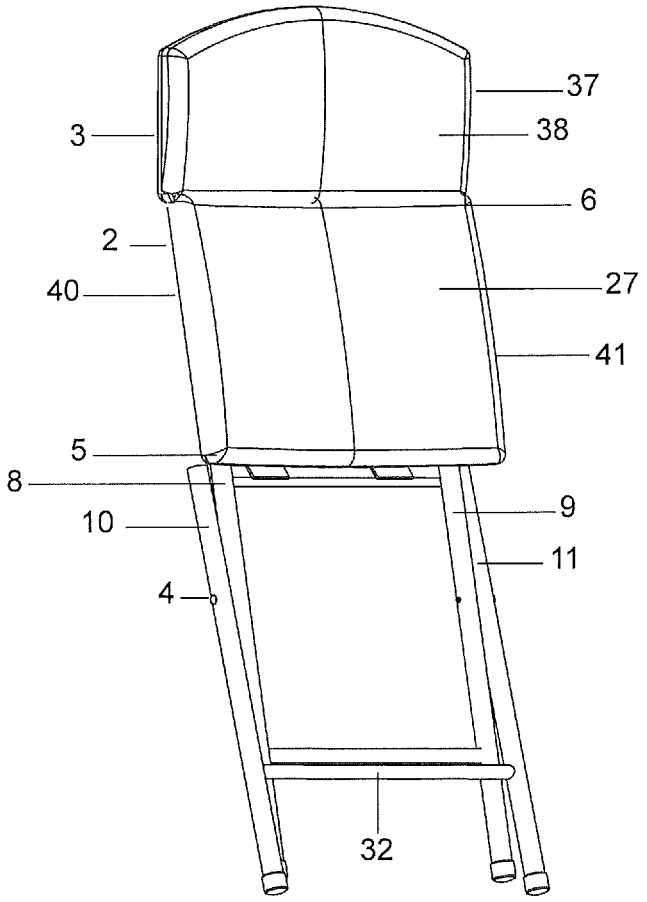
FIG. 19 is a front perspective view of the same embodiment of the present invention chair in its folded configuration.
Figure 20:
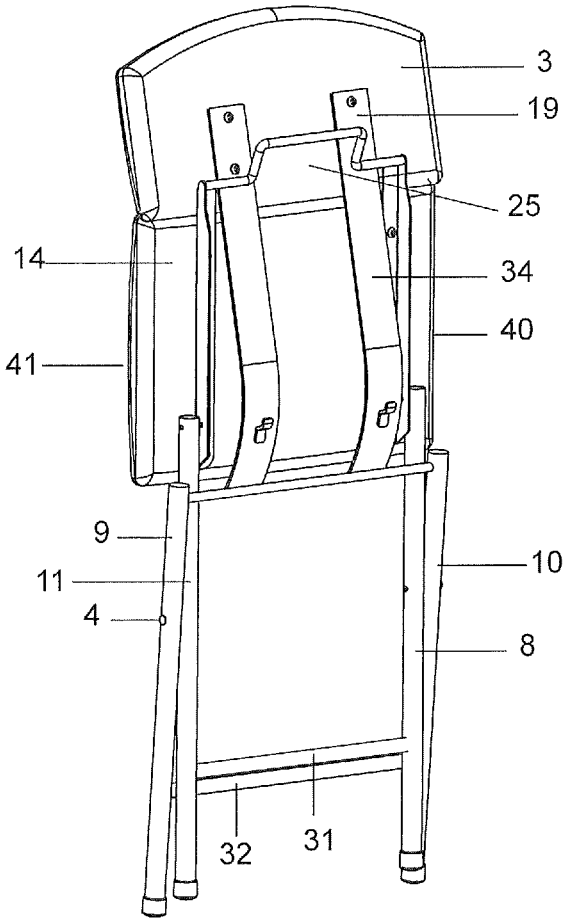
FIG. 20 is a rear perspective view of the embodiment chair in its folded configuration.
Figure 21:
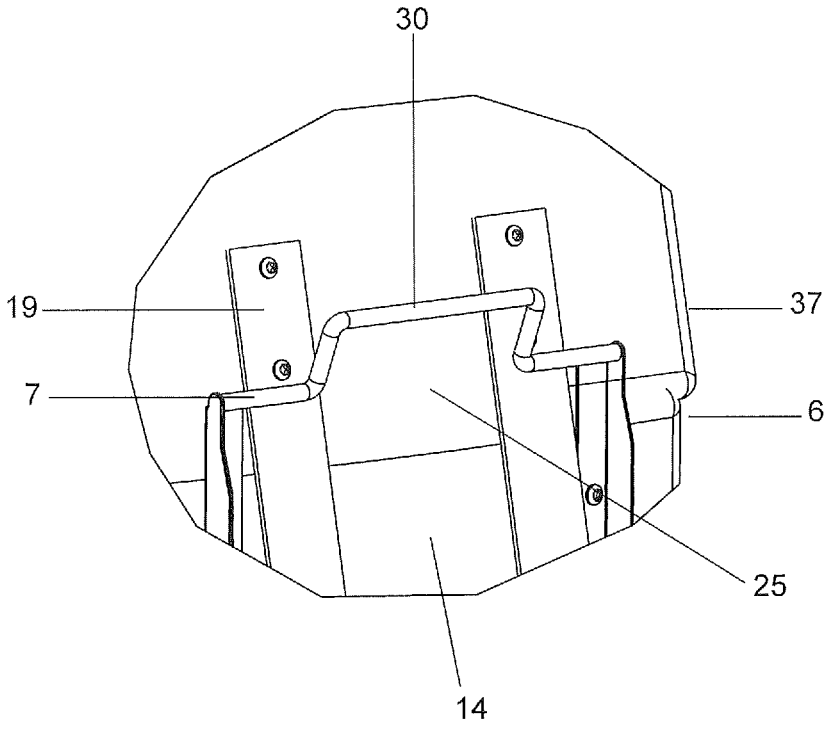
FIG. 21 is an enlarged view showing a portion of the rear of the chair of FIG. 20 showing the positioning and arrangement of the guide-support bar in relation to the back component when the embodiment chair is in the folded configuration.
Figure 22:
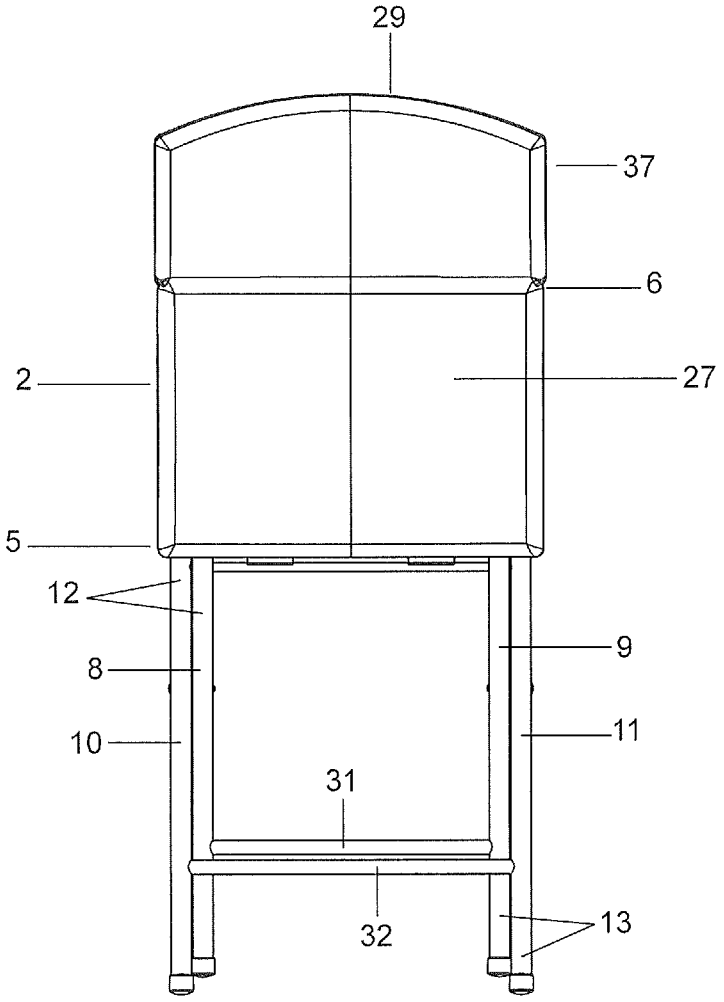
FIG. 22 is a front elevation view of the embodiment chair in its folded configuration.
Figure 23:
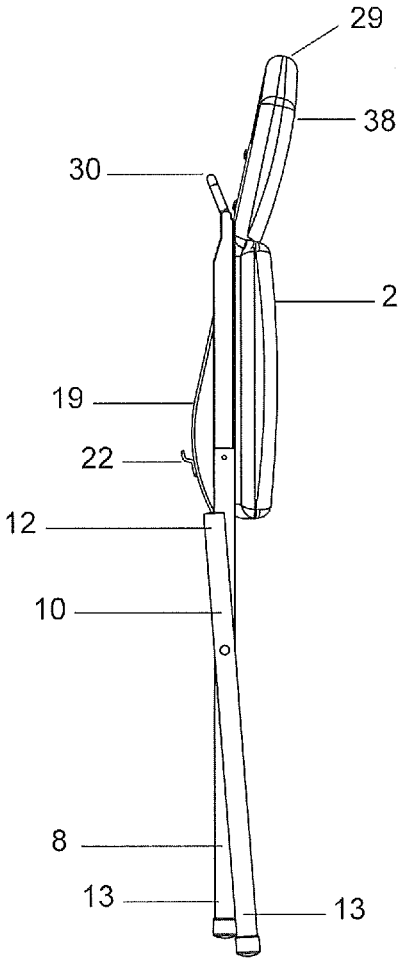
FIG. 23 is a right side elevation view of the embodiment chair in its folded configuration.
Figure 24:
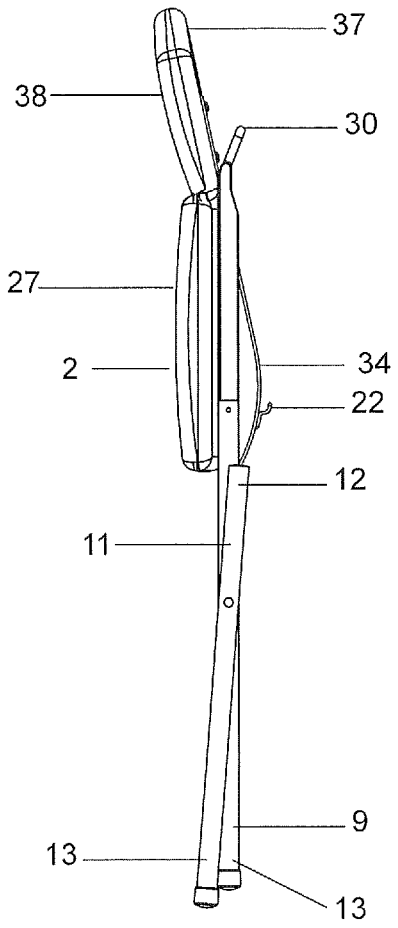
FIG. 24 is a left side elevation view of the embodiment chair in its folded configuration.
Figure 25:
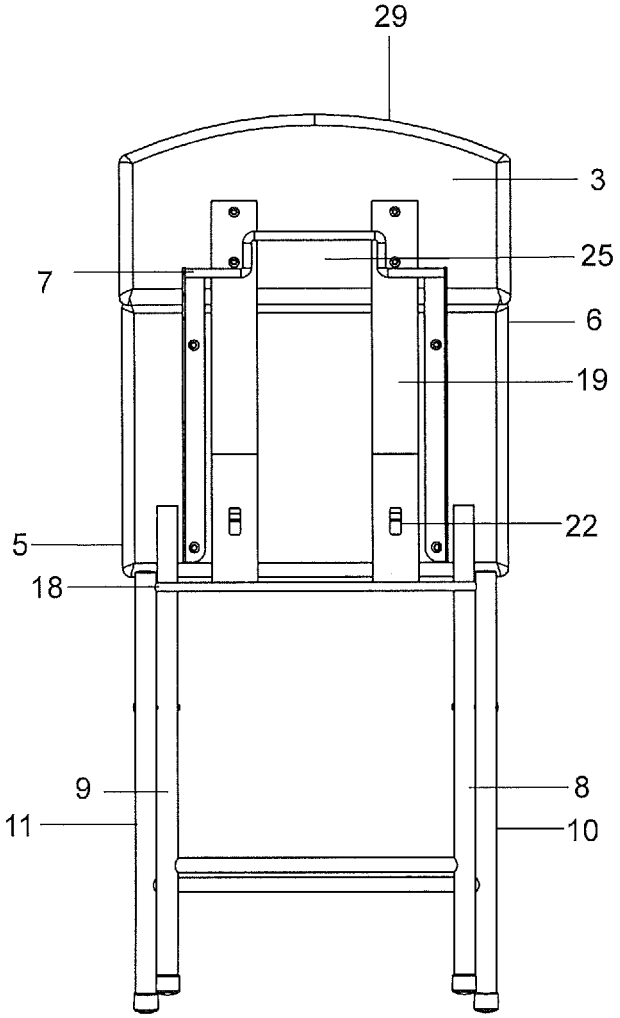
FIG. 25 is a rear elevation view of the embodiment chair in its folded configuration.
Figure 26:
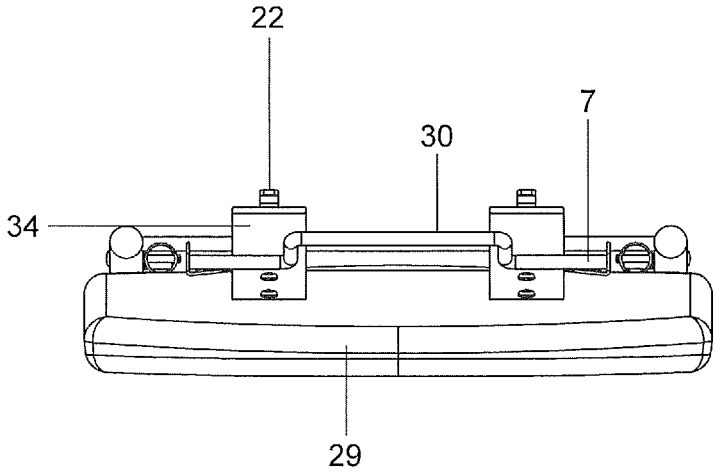
FIG. 26 is a top plan view of the embodiment chair in its folded configuration.
Figure 27:
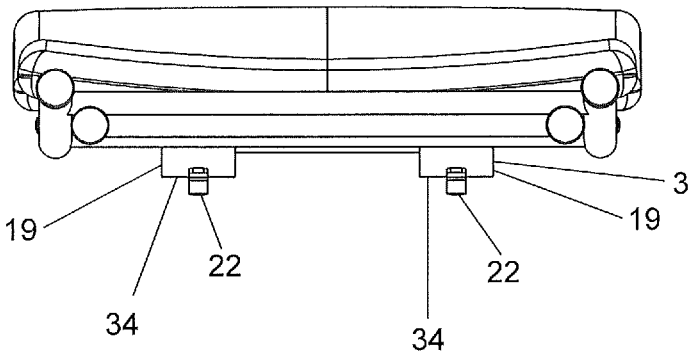
FIG. 27 is a bottom plan view of the embodiment chair in its folded configuration.

The present invention is directed to a folding chair capable of assuming a folded configuration, a configuration for a first sitting position and a configuration for a second sitting position. FIGS. 1-9 show a preferred embodiment of the inventive chair configured for a first (relaxed) sitting position. FIGS. 10-18 depict the same preferred embodiment of the folding chair configured for a second (dining table) sitting position. FIGS. 19-27 show the same preferred embodiment chair in its folded configuration.

As shown in the figures, the present invention folding chair 1 comprises a seat component 2, a back component 3 and a leg component 4. Seat component 2 has a sitting surface 27, a seat front 5 and a seat rear 6. Seat front 5 is in opposed physical relationship to seat rear 6 on seat component 2 Seat component 2 further includes two opposing seat sides 40, 41, each seat side 40, 41 extends between seat front 5 and seat rear 6. Seat rear 6 of seat component 2 includes rear seat edge 36. Guide-support bar 7 is connected to seat rear 6. In a preferred embodiment guide-support bar 7 includes handle 30 to aid in positioning chair 1 among the folded position and sitting positions.

Folding chair 1 further includes leg component 4. Leg component 4 includes a first pair of legs comprising a first leg 8 and a second leg 9. In the shown preferred embodiment legs 8, 9 are in parallel arrangement with each other. Leg component 4 also includes a second pair of legs comprising a third leg 10 and a fourth leg 11. In the shown preferred embodiment legs 10, 11 of the second pair of legs are also in parallel arrangement with each other. Each of the legs 8, 9, 10 and 11 has a top 12 and a bottom 13.

As seen in the figures, first leg 8 is pivotally connected to third leg 10. Similarly, second leg 9 is pivotally connected to the fourth leg 11. In the depicted embodiment chair, when chair 1 is in either sitting configuration, legs 8, 9 descend diagonally downward and rearward from seat front 5 to the floor below seat rear 6. When chair 1 is in either sitting configuration, legs 10, 11 descend diagonally downward and forward from the area near seat rear 6 to the floor below seat front 5. Hence, the first pair of legs 8, 9 and the second pairs of legs 10, 11 form a cross frame in which the pivotally attached legs move in scissor-like fashion in relation to each other. Pivotally attached legs 8, 10 are arranged so as to be situated on one side 40 of seat component 2 when chair 1 is in either of the first or second sitting positions. Likewise, pivotally attached legs 9, 11 are arranged so as to be situated on the other side 41 of seat component 2 when chair 1 is in either of the first or second sitting positions.

As best seen in the views of the rear of chair 1, a first cross member 18 extends from the top 12 of the third leg 10 to the top 12 of the fourth leg 11. First cross member 18 adds rigidity and strength to chair 1. Its length is determined in relation to the desired width of seat component 2 and operates to define the overall width of chair 1. Chair 1 can include additional cross members extending between first and third legs 8, 10 and also between the second and fourth legs 9, 11. In the depicted embodiment, chair 1 includes second cross member 31 connected to and extending between the lower part of each of first and second legs 8, 9 and third cross member 32 connected to and extending between the lower part of each of second and fourth legs 10, 11.

As noted, chair 1 includes back component 3. Back component 3 comprises vertical element 19 and back rest 37. Vertical element 19 can comprise any number of elongate structures sufficient to provide back support. In the preferred embodiment in the figures, vertical element 19 is formed from two flat slats 34 of sufficient thickness so as to be rigid and strong enough to support the back of an occupant. Vertical element 19 has a top 20 and bottom 21. As shown in the depicted embodiment, vertical element 19 formed from slats 34 attaches to back rest 37 and forms an elongate rigid frame structure. Bottom 21 of vertical element 19 is fixed to first cross member 18 and extends vertically upward therefrom. In the depicted embodiment, back rest 37 is attached to the top 20 of vertical element 19. In an alternative embodiment, back rest 37 could be integrally formed from or with vertical element 19. Back rest 37 includes support surface 38 which is preferably shaped and contoured as in the figures to comfortably receive the back of an occupant when the chair is in either the first or second sitting configurations.

Vertical element 19 includes a front surface 35 upon or adjacent which edge 36 of seat rear 6 may slidably travel to allow chair 1 to assume its folded and sitting positions. Accordingly, seat rear 6 slidably travels along vertical element 19 to configure chair 1 from a foldable configuration to a sitting configuration. In the preferred embodiment shown in the drawings, rear seat edge 36 would slidably travel along surface 35 of slats 34 to allow chair 1 to assume its folded and sitting positions. In the depicted embodiment chair 1, vertical element 19 is fixedly connected to first cross member 18 by welding, but may be connected in other known mechanical ways. At its connection point with first cross member 18, bottom 21 of vertical element 19 is arcuate to guide seat rear 6 into a formation that allows chair 1 achieve either of the first or second sitting positions. When the chair is in either sitting position, bottom 21 of vertical element 19 (slats 34 in the embodiment shown) extends under seat rear 6.

To allow chair 1 to fold and achieve the first and second sitting positions, seat front 5 is pivotally attached to the tops 12 of the first and second legs 8, 9. In contradistinction to other folding chairs and chairs offering multiple sitting positions, seat rear 6 is not connected to either leg component 4 or back component 3. By not connecting seat rear 6 in such fashion, seat rear 6 is adapted for slidable travel along vertical element 19 between the top 20 and bottom 21 of the vertical element 19. In this respect, when seat rear 6 is situated at its position of topmost travel along the vertical element 19, chair 1 is in the folded position. When seat rear 6 is situated at its position of bottommost travel along vertical element 19, the chair is in a first sitting position.

To allow chair 1 to assume a second sitting position having a seat height appropriate for a standard dining table, vertical element 19 includes at least one catch 22 situated between its top 20 and bottom 21. Preferably the at least one catch 22 is located near the bottom of vertical element 19. In the depicted preferred embodiment, chair 1 includes two catches 22, each located on one of slats 34 that form vertical element 19. Each catch 22 is adapted to receive guide-support bar 9 and hold seat rear 6 in an arrangement that allows chair 1 to assume the second sitting position.

As can be seen in the figures, in the depicted embodiment chair 1 vertical element 19 extends through the area formed between edge 36 at seat rear 6 and guide-support bar 7. The area between edge 36 at seat rear 6 and guide-support bar 7 thus defines a guide space 25 in which vertical element 19 extends through (within). Guide space 25 thus serves as a guide that guides seat rear 6 of seat component 2 in relation to vertical element 19 as it travels along vertical element 19 when the chair is configured among the folding position and either sitting position.

Seat component 2, back component 3 and leg component 4 can be made from any known material of sufficient strength useful in making furniture such as metal, plastic or wood. It is typical that folding chairs be made of an all-steel construction when balancing strength, durability and cost concerns. The present invention folding chair can be made of such construct. However, typical prior art folding chairs have rigid metal seats and seat backs which can be uncomfortable or visually unappealing. To avoid these problems, seat component 2 and back rest 37 can be made of plastic or wood. Alternatively, seat component 2 and back rest 37 could respectively include sitting surface 27 and support surface 38, which surfaces could be made from plastic, wood or cushioned fabric to enhance the aesthetics or comfort of chair 1. The present invention design lends itself to a high end version with a choice of different materials and upholsteries.

Moreover, the present invention is easy to set up and take down, or fold and unfold. Chair 1 can be configured from the folded position shown in FIGS. 19-27 to either sitting position by having a user grasp the top 29 of the chair with one hand and handle 30 with the other hand. While holding the chair in this fashion, the user need only push handle 30 down and along vertical element 19 to open the chair and place it in a sitting position configuration. If a configuration for a dining (second) sitting position is desired, then the user can direct guide-support bar 7 into catches 22 and chair 1 will assume a configuration for use at a dining table. If a configuration for a more relaxed (first) sitting position is desired, the user will push handle 30 (and adjoined seat rear 6) all the way to the bottom 21 of vertical element 19 until seat rear 6 reaches the bottom of vertical element 19. In the shown preferred embodiment first sitting configuration shown in FIGS. 1-9, the underside 14 of seat component 2 rests upon first cross member 18.

The present invention folding chair could be easily adapted to accommodate more than two sitting positions. This could be done by simply adding additional catches above or below the dining position catch on vertical element 19.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A folding chair (1) capable of assuming a folded configuration, a first sitting configuration and a second sitting configuration, the folding chair comprising:

a seat component (2), a back component (3) and a leg component (4);

the seat component (2) having a seat front (5), a seat rear (6) and a guide-support bar (7) connected to the seat rear (6);

the leg component (4) comprising a first pair of legs including a first leg (8) and a second leg (9) and a second pair of legs comprising a third leg (10) and a fourth leg (11);

each of the legs (8, 9, 10, 11) having a top (12) and a bottom (13);

the first leg (8) being pivotally connected to the third leg (10) and the second leg (9) being pivotally connected to the fourth leg (11);

a first cross member (18) extending from the top (12) of the third leg (10) to the top (12) of the fourth leg (11);

the back component (3) comprising a vertical element (19), the vertical element (19) having a top (20) and bottom (21);

the bottom (21) of the vertical element (19) being connected to the first cross member (18) and extending vertically upward therefrom;

the seat front (5) being pivotally attached to the tops (12) of the first and second legs (8, 9) and the seat rear (6) not being connected to either the leg component (4) or the back component (3), but instead being adapted for slidable travel along the vertical element (19) between the top (20) and bottom (21) of the vertical element (19); and wherein when the seat rear (6) is situated:

(a) at its configuration of topmost travel along the vertical element (19) the chair is in the folded configuration; and (b) at its configuration of bottommost travel along the vertical element (19) the chair is in a first sitting configuration; and the vertical element (19) including at least one catch (22) situated between the top (20) and bottom (21) of the vertical element (19) and adapted to receive the guide-support bar (7) and hold the seat component (2) such that the chair is in the second sitting configuration.

2. The chair of claim 1 wherein the vertical element (19) constitutes two slats (34).

3. The chair of claim 2 wherein each slat (34) includes a catch (22).

4. The chair of claim 1 wherein the guide-support bar (7) includes a handle (30).

5. The chair of claim 1 wherein the seat component (2) has a rear seat edge (36) and the guide-support bar (7) is situated at a spaced distance from rear seat edge (36) and creates a guide-space (25) in which vertical element (19) extends through.

6. The chair of claim 5 where the second sitting configuration is a configuration appropriate for use with a standard dining table.

7. The chair of claim 5 wherein the bottom (21) of vertical element (19) is arcuate at its connection point with first cross member (18).

8. The chair of claim 1 where the second sitting configuration is a configuration appropriate for use with a standard dining table.

9. The chair of claim 1 wherein the bottom (21) of vertical element (19) is arcuate at its connection point with the first cross member (18).

* * * * *